US005804517A

United States Patent [19]

Ishii et al.

[11] Patent Number: 5,804,517

[45] Date of Patent: Sep. 8, 1998

[54] FLEXIBLE NONWOVEN FABRIC AND LAMINATE THEREOF

[75] Inventors: Hiroshi Ishii; Kunihiko Takesue; Kunie Hiroshige, all of Kuga-gun, Japan

[73] Assignee: Mitsui Petrochemical Industries, Ltd., Tokyo, Japan

[21] Appl. No.: 936,434

[22] Filed: Sep. 24, 1997

[30] Foreign Application Priority Data

Sep. 30, 1996 [JP] Japan ..... 8-257958
Jul. 14, 1997 [JP] Japan ..... 9-188770

[51] Int. Cl.[6] ..... D02G 3/00

[52] U.S. Cl. ..... 442/361; 442/364; 442/398

[58] Field of Search ..... 442/364, 361, 442/398

[56] References Cited

U.S. PATENT DOCUMENTS 5,540,992 7/1996 Marcher et al. ..... 442/364
5,545,464 8/1996 Stohej ..... 442/361

*Primary Examiner*—James J. Bell
*Attorney, Agent, or Firm*—Birch, Stewart, Kolasch & Birch, LLP

[57] ABSTRACT

A flexible nonwoven fabric comprising conjugate long fibers of sheath-core type comprising a core of a resin having a high melting point and a polyethylene sheath is provided. The fiber has a weight ratio of the resin of the high melting point to the polyethylene of from 5/95 to 20/80 and a fineness of up to 3.0 denier, and the nonwoven fabric has a sum of bending resistance in machine and transverse directions as measured by Clark method (method C in JIS L1096) of up to 80 mm. The flexible nonwoven fabric has excellent texture and frictional resistance. A laminate comprising such flexible nonwoven fabric and a gas-permeable film is also provided.

10 Claims, No Drawings

FLEXIBLE NONWOVEN FABRIC AND LAMINATE THEREOF

BACKGROUND OF THE INVENTION

This invention relates to a flexible nonwoven fabric and a laminate thereof. More specifically, this invention relates to a flexible nonwoven fabric which has excellent flexibility and texture, and which is quite adequate for use as a medical, hygienic material such as disposal diaper or an industrial material such as packaging material and clothing.

Nonwoven fabrics prepared from polyethylene fiber have been known to be highly flexible and excellent in their texture (see JP-A-60-209010). The polyethylene fiber, however, is difficult to spin, and spinning of the polyethylene fiber of high fineness is quite difficult. In addition, the polyethylene fiber often melts when it is exposed to heat and/or pressure when the nonwoven fabric is processed with a calender roll, and during such processing, the fiber often became wound around the roll due to the insufficient strength of the fiber. The countermeasure for such problem has been use of a lower temperature in the production of the nonwoven fabric, which resulted in an insufficient mutual bonding of the fibers and hence, in an insufficient frictional resistance of the nonwoven fabric and a strength inferior to that of the nonwoven fabric prepared from polypropylene fibers.

In order to obviate such problem of thermal bonding of the fibers, production of a nonwoven fabric from conjugate fibers of sheath-core type has been proposed in JP-B-55-483, JP-A-2-182960 and JP-A-5-263353. In these fibers, polyethylene is used for the sheath and polypropylene, polyester or the like is used for the core.

In the conjugate fibers of sheath-core type that have been so far proposed, the polypropylene or the polyester constituting the core of the conjugate fiber consisted more than 50% of the conjugate fiber, and as a result, the rigidity of the resin constituting the core reflected on the properties of the conjugate fiber, and the nonwoven fabric prepared from such fibers exhibited a rigidity higher than the nonwoven fabric prepared solely from polyethylene. In addition to the insufficient flexibility, such nonwoven fabric also suffered from inferior texture and frictional resistance.

SUMMARY OF THE INVENTION

In view of such situation, first object of the present invention is to provide a flexible nonwoven fabric wherein texture and frictional resistance are markedly improved without detracting from flexibility inherent to the polyethylene nonwoven fabric; and in particular, to provide a flexible nonwoven fabric which is adequate for use as a medical, hygienic material such as disposable diaper or an industrial material such as wrapping material.

Second object of the present invention is to provide a laminate wherein the flexible nonwoven fabric is used.

In order to attain the first object of the invention, there is provided in the present invention a flexible nonwoven fabric comprising conjugate long fibers of sheath-core type comprising a core of a resin having a high melting point and a polyethylene sheath, wherein said fiber has a weight ratio of said resin of the high melting point to said polyethylene of from 5/95 to 20/80 and a fineness of up to 3.0 denier, and said nonwoven fabric has a sum of bending resistance in machine and transverse directions as measured by Clark method (method C in JIS L1096) of up to 80 mm.

The resin having the high melting point is preferably a polypropylene having a Mw/Mn ratio of from 2 to 4, and the polyethylene is preferably the one having a Mw/Mn ratio of from 1.5 to 4.

The resin having the high melting point is preferably a polypropylene having a melt flow rate of from 30 to 80 g/10 minutes and a Mw/Mn ratio of up to 3, and the polyethylene is preferably the one having a melt flow rate of from 20 to 60 g/10 minutes and a Mw/Mn ratio of up to 3.

In order to attain the second object of the invention, there is provided a laminate comprising the flexible nonwoven fabric as described above and a gas-permeable film.

The gas-permeable film is preferably a microporous polyolefin film.

BEST MODE FOR CARRYING OUT THE INVENTION

Next, the flexible nonwoven fabric of the present invention (hereinafter referred to as the nonwoven fabric of the invention) and the laminate thereof are described in detail.

The nonwoven fabric of the invention is a nonwoven fabric comprising conjugate long fibers of sheath-core type. The conjugate long fibers of sheath-core type comprises a core of a resin having a high melting point and a polyethylene sheath. The core may be covered by a concentric or an eccentric sheath, or alternatively, the core and the sheath may be laid one beside the other. In view of the texture, it is most preferable that the core is covered by a concentric or an eccentric sheath without exposing the resin having a high melting point.

Exemplary resins having the high melting point used for the core include polypropylene, polyethylene terephthalate, and polyamide such as Nylon, among which the polypropylene being preferred.

The polypropylene used may be a homopolymer of propylene, or a copolymer of propylene with an α-olefin such as ethylene, 1-butene, 1-pentene, 1-hexene, 1-octene, or 4-methyl-1-pentene, the propylene being the main component. The propylene homopolymer or the copolymer as mentioned above may be used either alone or in combination of two or more. In view of good spinnability and high productivity of the fiber and the high flexibility of the resulting nonwoven fabric, it is preferable to use a random copolymer of propylene with a minor amount of structural unit derived from ethylene at a content in the range of from 0.5 to 5% by mole. The term "spinnability" is herein used to designate the conditions that the filament or the fiber ejected from the spinning nozzle and being stretched would not be snapped or cut, and would not become fused to each other.

The propylene may preferably have a melt flow rate (MFR) of from 20 to 100 g/10 minutes, and most preferably, a melt flow rate of from 30 to 80 g/10 minutes in view of the good balance between the spinnability and fiber strength. In the present invention, the melt flow rate (MFR) of the polypropylene is measured in accordance with ASTM D1238 at a temperature of 230° C. under the load of 2.16 kg.

The propylene may have a ratio of weight average molecular weight (Mw) to number average molecularweight (Mn) (Mw/Mn ratio) in the range of from 2 to 4. For producing a fiber in good spinnability and excellent strength, the Mw/Mn ratio is preferably up to 3. In the present invention, the Mw/Mn ratio is measured by GPC (gel permeation chromatography) according to the conventional method.

The polyethylene which constitutes the sheath of the sheath-core type conjugate long fiber may be a homopolymer of polyethylene or a copolymer of ethylene with an α-olefin such as propylene, 1-butene, 1-pentene, 1-hexene, and 1-octene. The ethylene homopolymer or the copolymer as mentioned above may be used either alone or in combination of two or more.

The polyethylene may preferably have a melt flow rate of from 20 to 60 g/10 minutes for producing a fiber having good spinnability, strength, and frictional resistance. In the present invention, the melt flow rate (MFR) of the polyethylene is measured in accordance with ASTM D1238 at a temperature of 190° C. under the load of 2.16 kg.

The polyethylene may have a ratio of weight average molecular weight (Mw) to number average molecular weight (Mn) (Mw/Mn ratio) in the range of from 1.5 to 4. For producing a fiber having good spinnability, strength and frictional resistance, the Mw/Mn ratio is preferably up to 3.

The polyethylene may also have a density of 0.92 to 0.97 g/cm$^3$ in view of the good frictional resistance of the resulting fiber. For producing a fiber having both high flexibility and sufficient frictional resistance, the density is preferably in the range of from 0.94 to 0.96 g/cm$^3$, more preferably from 0.94 to 0.955 g/cm$^3$, and most preferably, from 0.94 to 0.95 g/cm$^3$.

In the present invention, the resin having the high melting point used for the core and the polyethylene used for the sheath of the sheath-core type conjugate long fiber may optionally include other polymers, colorants, heat stabilizers, nucleating agents, lubricants or the like to the extent that the merits of the present invention is not interfered. Exemplary colorants include inorganic colorants such as titanium oxide, calcium carbonate and organic colorants such as phthalocyanine. Exemplary heat stabilizers include phenolic stabilizers such as BHT (2,6-di-tert-butyl-4-methylphenol). In the present invention, it is particularly preferable in view of the frictional resistance of the resulting fiber if the polyethylene constituting the sheath of the fiber is the one containing 0.1 to 0.5% by weight of the lubricant. Exemplary lubricants that may be used include oleic amide, erucic amide, and stearic amide.

In the present invention, the sheath-core type conjugate long fiber may have a weight ratio of the polypropylene (A) to the polyethylene (B) of from 5/95 to 20/80. The ratio is preferably in the range of from 10/90 to 20/80 for increasing the fineness of the fiber. The polypropylene content in the conjugate fiber of less than 5 would result in the failure of improving the fiber strength, while the polypropylene content in excess of 20 is associated with the risk of inferior flexibility of the resulting nonwoven fabric.

The ratio in cross-sectional area of the core to the sheath of the sheath-core type conjugate long fiber may be in the range of from 5/95 to 20/80, which in general is substantially equivalent to the ratio in weight.

In the nonwoven fabric of the present invention, the sheath-core type conjugate long fiber may have a fineness of up to 3.0 denier, and more preferably, up to 2.5 denier for obtaining the nonwoven fabric of higher flexibility. The conjugate long fiber may have either one of concentric arrangement wherein, when seen in cross sectional view, the circular core is concentrically arranged in the sheath of doughnut shape; eccentric arrangement wherein the core is eccentrically arranged in and surrounded by the eccentric sheath; and uncovered arrangement wherein the core is eccentrically arranged inside the eccentric sheath but some part of the core is exposed to the exterior without being covered by the sheath.

The nonwoven fabric of the present invention also has a sum of bending resistance in machine and transverse directions of up to 80 mm. In the present invention, the bending resistance is measured by Clark method according to JIS L1096, method C, and the machine direction and the transverse direction respectively designate the direction parallel to the flow of the web in the formation of the nonwoven fabric and the direction perpendicular to the direction of the web flow.

The nonwoven fabric of the present invention may generally have a areal weight of up to 25 g m$^2$ when the nonwoven fabric is used to the applications wherein flexibility of the nonwoven fabric is required. The nonwoven fabric may have a higher areal weight when it is used for such purpose as wrapping sheet or medical cover sheet.

The nonwoven fabric of the present invention is produced by melting each of the polypropylene for the core and the polyethylene for the sheath of the sheath-core type conjugate long fiber in different extruders or the like; ejecting each of the molten resin from a spinneret having conjugate spinning nozzles capable of forming the desired sheath-core structure to spin the sheath-core type conjugate long fibers; cooling the thus spun conjugate long fibers with a cooling fluid; adjusting the fineness of the long fiber to the desired fineness by stretching the fiber with stretching air stream; depositing the fibers directly on a collecting belt to the predetermined thickness; and entangling the fibers to each other by an adequate means.

The fibers may be entangled by any one or combination of thermal embossing with an embossing roll, fusion bonding by ultrasonic heating, entangling by water jet or hot-air-through, and needle punching. Among these, thermal embossing with an embossing roll whereby the nonwoven fabric is partly heat bonded is preferred in view of the improved frictional resistance of the resulting nonwoven fabric. Proportion of the area thermally embossed in the total area of the nonwoven fabric (proportion of embossed area) may be determined depending on the specific application in which the nonwoven fabric is used. In general, the proportion of the embossed area, however, is preferably in the range of from 5 to 40% in view of the good balance between flexibility, gas permeability, and frictional resistance of the resulting nonwoven fabric.

Another aspect of the present invention is a laminate of a flexible nonwoven fabric and a gas-permeable film. The flexible nonwoven fabric of the laminate is the flexible nonwoven fabric as described above. The gas-permeable film is a film which would not allow any liquid such as water to permeate therethrough while allowing the permeation of a gas such as water vapor and air. In the present invention, the film used is not limited to any particular type, and any conventional gas-permeable film may be used. A typical gas-permeable film is the one produced by forming a film from a thermoplastic resin having added thereto a filler which is preferably a filler having a particle size of from 0.1 to 7 mm; and monoaxially or biaxially stretching the film to a draw ratio of at least 1.5, and preferably to a draw ratio of from 1.5 to 7. Among various gas-permeable films, the preferred are microporous polyolefin films in view of their good adhesion to the nonwoven fabric of the present invention and their inherent flexibility.

The polyolefin resin used in making the microporous polyolefin films may be a homopolymer or a copolymer of an $\alpha$-olefin such as ethylene, propylene or 1-butene. Typical examples of the polyolefin resins include polyethylenes such as high density polyethylene, medium density polyethylene, low-pressure low density polyethylene (linear low density polyethylene), and high-pressure low density polyethylene, polypropylene, propylene-ethylene random copolymer, and poly-1-butene. Among these, the preferred are the low-pressure low density polyethylene and the high-pressure low density polyethylene, and in particular, the low-pressure low density polyethylene in view of niselessness of the laminate.

The laminate of the present invention wherein the microporous polyolefin film has the porosity (rate of pore volume to apparent volume of the film) of at least 30% and the water vapor permeability of from 2000 to 7000 g/m$^2$/24 hr (JIS Z0208) is quite preferable as a material to be used in a disposable diaper.

The nonwoven fabric of the present invention is flexible and excellent in both surface texture and frictional resistance, and therefore, the nonwoven fabric of the present invention is adequate for use as a packaging material, clothing material, and diaper material. The laminate of the present invention is also flexible and excellent in both surface texture and frictional resistance, and therefore, the laminate of the present invention is quite adequate for the applications where such properties are required, for example, back sheet and side gathers of a diaper.

EXAMPLES

Next, the present invention is described in further detail by referring to the Examples of the invention and Comparative Examples, which by no means limit the scope of the invention as long as the Examples are within the scope of the present invention.

Examples 1 to 8 and Comparative Examples 1 to 3

In each of the Examples and Comparative Examples, a polypropylene having the MFR, the Mw/Mn ratio and the ethylene content of structural unit derived from ethylene as shown in Tables 1 to 3 and a polyethylene having the MFR, the Mw/Mn ratio and the density as shown in Tables 1 to 3 with oleic amide (0.3% by weight contained in the polyetylene) were respectively melt kneaded in different extruders, and the thus kneaded resins were ejected from a spinneret having 1093 conjugate spinning nozzles each having a diameter of 0.6 mm at a rate of 1.0 g/min per each nozzle to produce conjugate long fibers of sheath-core type comprising the polypropylene core and the polyethylene sheath each having the polypropylene/polyethylene (A/B) weight ratio and fiber fineness as shown in Table 1. The resulting conjugate long fibers of sheath-core type were directly allowed to deposit on the collecting surface, and entangled to each other by embossing 20% in area of the deposited web with a heated emboss roll to produce the flexible nonwoven fabric having a areal weight of 23 g/m$^2$.

The resulting flexible nonwoven fabrics were evaluated for their bending resistance in machine and transverse directions by Clark method (method C in JIS L1096), and the value in both directions were added.

The resulting flexible nonwoven fabrics were also evaluated for their frictional resistance by rubbing the fabrics with Gakushin-model frictional resistance tester (which is based on Model II frictional resistance tester according to JIS L0823) for 100 times (back and forth) under the load of 300 g (added to 200 g of friction unit), and comparing the resulting sample with the standard samples by visual inspection. The evaluation was effected in accordance with the following criteria:

⊙: no pills formed without becoming fuzzy,

○: no pills formed but became fuzzy,

Δ: pills formed and became fuzzy, and

X: tearing of the nonwoven fabric.

The results are shown in Tables 1 to 3.

TABLE 1

| | | Unit | Ex. 1 | Ex. 2 | Ex. 3 | C.E. 1 |
|---|---|---|---|---|---|---|
| Resin A | MFR | g/10 min | 65 | 65 | 65 | 65 |
| | Mw/Mn | — | 2.5 | 2.5 | 2.5 | 2.5 |
| | Ethylene content* | % by mole | 0.5 | 0.5 | 0.5 | 0.5 |
| Resin B | MFR | g/10 min | 30 | 30 | 30 | 30 |
| | Mw/Mn | — | 3.0 | 3.0 | 3.0 | 3.0 |
| | Density | g/cm$^3$ | 0.948 | 0.948 | 0.948 | 0.948 |
| A/B weight ratio | | — | 20/80 | 10/90 | 5/95 | 25/75 |
| Fineness | | d | 2.0 | 2.0 | 2.0 | 2.0 |
| Bending resistance (M.D. + T.D.) | | mm | 80 | 76 | 75 | 85 |
| frictional resistance | | — | ○ | ○ | ○ | X |

Notes:
MFR: melt flow rate
M.D: machine direction, T.D.: transverse direction
Resin A: polypropylene (propylene-ethylene random copolymer)
Resin B: polyethylene (ethylene/1-butene copolymer)
Ethylene content:content of structural unit of ethylene

TABLE 2

| | | Unit | Ex. 4 | Ex. 5 | C.E. 2 | C.E. 3 |
|---|---|---|---|---|---|---|
| Resin A | MFR | g/10 min | 65 | 65 | 65 | 65 |
| | Mw/Mn | — | 2.5 | 2.5 | 2.5 | 2.5 |
| | Ethylene content* | % by mole | 0.5 | 0.5 | 0.5 | 0.5 |
| Resin B | MFR | g/10 min | 20 | 30 | 20 | 40 |
| | Mw/Mn | — | 2.7 | 3.0 | 3.9 | 3.0 |
| | Density | g/cm$^3$ | 0.945 | 0.948 | 0.920 | 0.965 |
| A/B weight ratio | | — | 20/80 | 20/80 | 20/80 | 20/80 |
| Fineness | | d | 2.0 | 2.0 | 3.2 | 2.2 |
| Bending resistance (M.D. + T.D.) | | mm | 80 | 80 | 88 | 90 |
| frictional resistance | | — | ○ | ○ | Δ | ⊙ |

Notes:
Resin A: polypropylene (propylene-ethylene random copolymer)
Resin B: polyethylene (ethylene/1-butene copolymer)
Ethylene content:content of structural unit of ethylene

TABLE 3

| | | Unit | Ex. 6 | Ex. 7 | Ex. 8 |
|---|---|---|---|---|---|
| Resin A | MFR | g/10 min | 65 | 65 | 65 |
| | Mw/Mn | — | 2.5 | 3.5 | 3.5 |
| | Ethylene content* | % by mole | 0.5 | 4.0 | 4.9 |
| Resin B | MFR | g/10 min | 30 | 30 | 30 |
| | Mw/Mn | — | 3.0 | 3.0 | 3.0 |
| | Density | g/cm$^3$ | 0.948 | 0.948 | 0.948 |
| A/B weight ratio | | — | 15/85 | 20/80 | 20/80 |
| Fineness | | d | 2.0 | 2.0 | 2.0 |
| Bending resistance (M.D. + T.D.) | | mm | 80 | 76 | 70 |
| frictional resistance | | — | ○ | ○ | ○ |

Notes
Resin A: polypropylene (propylene-ethylene random copolymer)
Resin B: polyethylene (ethylene/1-butene copolymer)
Ethylene content:content of structural unit of ethylene

Examples 9 to 11 and Comparative Example 4

The nonwoven fabrics obtained in the above-described Examples 1, 7 and 8 and Comparative Example 3 were respectively laminated with a microporous film of low-pressure low density polyethylene (LLDPE) shown in Table 4 (ESPOIR manufactured by Mitsui Toatsu Chemicals Inc.) using a hot melt adhesive (polyolefinic type, manufactured by H. B Fuller Japan Co., Ltd.) to prepare laminates.

The resulting laminates were evaluated for their aesthetic property in a monitor test by 10 testers. The laminates were evaluated in terms of the number of monitors who pointed out roughness, hookiness or prickliness and hardness according to the following criteria:

⊙: 0,

○: 1 to 2,

Δ: 3 to 5, and

X: 6 or more.

The results are shown in Table 4.

TABLE 4

| | | Unit | Ex. 9 | Ex. 10 | Ex. 11 | C.E. 4 |
|---|---|---|---|---|---|---|
| Resin A | MFR | g/10 min | 65 | 65 | 65 | 65 |
| | Mw/Mn | — | 2.5 | 3.5 | 3.5 | 2.5 |
| | Ethylene content* | % by mole | 0.5 | 4.0 | 4.9 | 0.5 |
| Resin B | MFR | g/10 min | 30 | 30 | 30 | 40 |
| | Mw/Mn | — | 3.0 | 3.0 | 3.0 | 3.0 |
| | Density | $g/cm^3$ | 0.948 | 0.948 | 0.948 | 0.965 |
| Film | Resin | | LLDPE | LLDPE | LLDPE | LLDPE |
| | Thickness | μm | 23 | 23 | 23 | 23 |
| | Water Vapor permeability | $g/m^2/24$ hr | 6000 | 6000 | 6000 | 6000 |
| Lamination | Type of the hotmelt adhesive | | poly-olefinic | poly-olefinic | poly-olefinic | poly-olefinic |
| | Coating weight, $g/m^2$ | | 1.0 | 1.0 | 1.0 | 1.0 |
| | Texture | | ○ | ○ | ○ | X |

Ethylene content:content of structural unit of ethylene

The flexible nonwoven fabric of the present invention has good flexibility and sufficient frictional resistance. Therefore, the flexible nonwoven fabric of the present invention may be used in a wide range of medical, hygienic applications such as disposable diapers, and industrial materials such as wrapping materials and clothing.

The laminate of the present invention has high flexibility and excellent surface texture as well as good frictional resistance. Therefore, the laminate of the present invention would be excellent material for the applications where such advantageous features of the laminate may be made use of, for example, for back sheet or side gathers of disposable diapers.

We claim:

1. A flexible nonwoven fabric comprising conjugate long fibers of sheath-core type comprising a core of a resin having a high melting point and a polyethylene sheath, wherein said fiber has a weight ratio of said resin of the high melting point to said polyethylene of from 5/95 to 20/80 and a fineness of up to 3.0 denier, and said nonwoven fabric has a sum of bending resistance in machine and transverse directions as measured by Clark method (method C in JIS L1096) of up to 80 mm.

2. A flexible nonwoven fabric according to claim 1 wherein said resin having the high melting point is a polypropylene having a Mw/Mn ratio of from 2 to 4, and said polyethylene is the one having a Mw/Mn ratio of from 1.5 to 4.

3. A flexible nonwoven fabric according to claim 1 wherein said resin having the high melting point is a polypropylene having a melt flow rate of from 30 to 80 g/10 minutes and a Mw/Mn ratio of up to 3, and said polyethylene is the one having a melt flow rate of from 20 to 60 g/10 minutes and a Mw/Mn ratio of up to 3.

4. A flexible nonwoven fabric according to claim 2 or 3 wherein said flexible nonwoven fabric is partially bonded by thermal bonding.

5. A flexible nonwoven fabric according to any one of claims 2 to 3 wherein said polyethylene has a melt flow rate of from 20 to 60 g/10 minutes and a density of from 0.92 to 0.97 $g/cm^3$.

6. A flexible nonwoven fabric according to any one of claims 2 to 3 wherein said polypropylene has a melt flow rate of from 20 to 100 g/10 minutes and contains 0.5 to 5.0% by mole of structural unit derived from ethylene.

7. A flexible nonwoven fabric according to any one of claims 2 to 3 wherein said polyethylene contains 0.1 to 0.5% by weight of a lubricant.

8. A laminate comprising a flexible nonwoven fabric comprising conjugate long fibers of sheath-core type comprising a core of a polypropylene having a Mw/Mn ratio of from 2 to 4 and a sheath of a polyethylene having a Mw/Mn ratio of from 1.5 to 4, wherein said fiber has a weight ratio of said polypropylene to said polyethylene of from 5/95 to 20/80 and a fineness of up to 3.0 denier; and said nonwoven fabric has a sum of bending resistance in machine and transverse directions as measured by Clark method (method C in JIS L1096) of up to 80 mm; and a gas-permeable film.

9. A laminate according to claim 8 wherein said gas-permeable film is a microporous polyolefin film.

10. A laminate according to claim 9 wherein said microporous polyolefin film has a porosity of at least 30% and water vapor permeability of from 2000 to 7000 $g/m^2/24$ hr.

* * * * *